US008235785B2

(12) United States Patent
Thomas

(10) Patent No.: US 8,235,785 B2
(45) Date of Patent: Aug. 7, 2012

(54) WAGERING GAME WITH OUTCOME BASED ON COMMUNITY AND INDIVIDUAL RANDOM EVENTS

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 561 days.

(21) Appl. No.: 12/438,313

(22) PCT Filed: Aug. 21, 2007

(86) PCT No.: PCT/US2007/018457

§ 371 (c)(1),
(2), (4) Date: Feb. 20, 2009

(87) PCT Pub. No.: WO2008/024330

PCT Pub. Date: Feb. 28, 2008

(65) Prior Publication Data

US 2010/0234090 A1 Sep. 16, 2010

Related U.S. Application Data

(60) Provisional application No. 60/838,984, filed on Aug. 21, 2006.

(51) Int. Cl.
*A63F 9/24* (2006.01)

(52) U.S. Cl. ..... 463/16; 463/20; 463/22

(58) Field of Classification Search ..... 463/16, 463/18, 20, 13, 22, 25, 29, 42; 273/138.1, 273/139, 461

See application file for complete search history.

(56) References Cited

U.S. PATENT DOCUMENTS

| | | | | |
|---|---|---|---|---|
| 2003/0125102 | A1* | 7/2003 | Cannon | 463/20 |
| 2005/0159208 | A1* | 7/2005 | Pacey | 463/20 |
| 2005/0170885 | A1 | 8/2005 | Poole et al. | 463/25 |
| 2006/0068868 | A1* | 3/2006 | Crawford et al. | 463/13 |
| 2006/0131810 | A1* | 6/2006 | Nicely | 273/292 |
| 2007/0054733 | A1* | 3/2007 | Baerlocher | 463/27 |

OTHER PUBLICATIONS

International Search Report—PCT/US06/20979 dated Aug. 7, 2008 (2 pages).

International Written Opinion—PCT/US2007/018457 dated Aug. 7, 2008 (3 pages).

* cited by examiner

*Primary Examiner* — Khiem D Nguyen
(74) *Attorney, Agent, or Firm* — Nixon Peabody LLP

(57) ABSTRACT

A method of conducting a wagering game on a gaming machine comprises selecting a plurality of playable elements from a set of playable elements. The method further comprises displaying an individual outcome having first elements randomly selected from a set of individual elements. The set of individual elements correspond to the set of playable elements. The method further includes displaying a community outcome having second elements randomly selected from a set of community elements. The set of community elements correspond to the set of playable elements. An award is achieved in response to the plurality of playable elements matching the randomly selected first and second elements.

22 Claims, 10 Drawing Sheets

WAGERING GAME WITH OUTCOME BASED ON COMMUNITY AND INDIVIDUAL RANDOM EVENTS

CROSS-REFERENCE To RELATED APPLICATIONS

This application is a U.S. national stage of International Application No. PCT/US2007/018457, filed Aug. 21, 2007, which is related to and claims the benefit of U.S. Provisional Application No. 60/838,984, filed Aug. 21, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to wagering games with outcomes based on community and individual random events.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to another aspect of the invention, a method of conducting a wagering game on a gaming system comprises selecting a plurality of playable elements from a set of playable elements. The method further comprises displaying an individual outcome having first elements randomly selected from a set of individual elements. The set of individual elements correspond to the set of playable elements. The method further includes displaying a community outcome having second elements randomly selected from a set of community elements. The set of community elements correspond to the set of playable elements. An award is achieved in response to the plurality of playable elements matching at least some of the randomly selected first and second elements.

According to one aspect of the present invention, a gaming machine for playing a wagering game includes a first player-input device for receiving a selection of playable elements bearing first indicia. The wagering game further includes at least one display for displaying a randomly selected community group of community elements bearing second indicia and a randomly selected individual group of individual elements bearing third indicia. An award is achieved in the wagering game by matching the first indicia of the playable elements to at least some of the second and third indicia.

According to yet another embodiment of the invention, a method of conducting a wagering game on a gaming system comprises displaying an individual outcome of the wagering game. The individual outcome is indicated by a plurality of symbols arranged in an individual array. The method further comprises displaying a community outcome indicated by a plurality of symbols arranged in a community array. The method also includes providing an award in response to a winning symbol combination located within a final array. The final array is defined by a combination of the individual array and the community array.

In still an additional aspect of the invention, a method of conducting a wagering game on a gaming system comprises determining a first individual outcome at a first gaming machine. The first individual outcome is indicated by a plurality of symbols arranged in a first individual array. The method further includes determining a second individual outcome at a second gaming machine. The second individual outcome is indicated by a plurality of symbols arranged in a second individual array. The method also comprises determining a community outcome being indicated by a plurality of symbols arranged in a community array. The method further comprises combining the first individual outcome with the community outcome to form a first overall outcome and combining the second individual outcome with the community outcome to form a second overall outcome. An award is achieved when either or both of the first overall outcome and second overall outcome form a winning combination.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
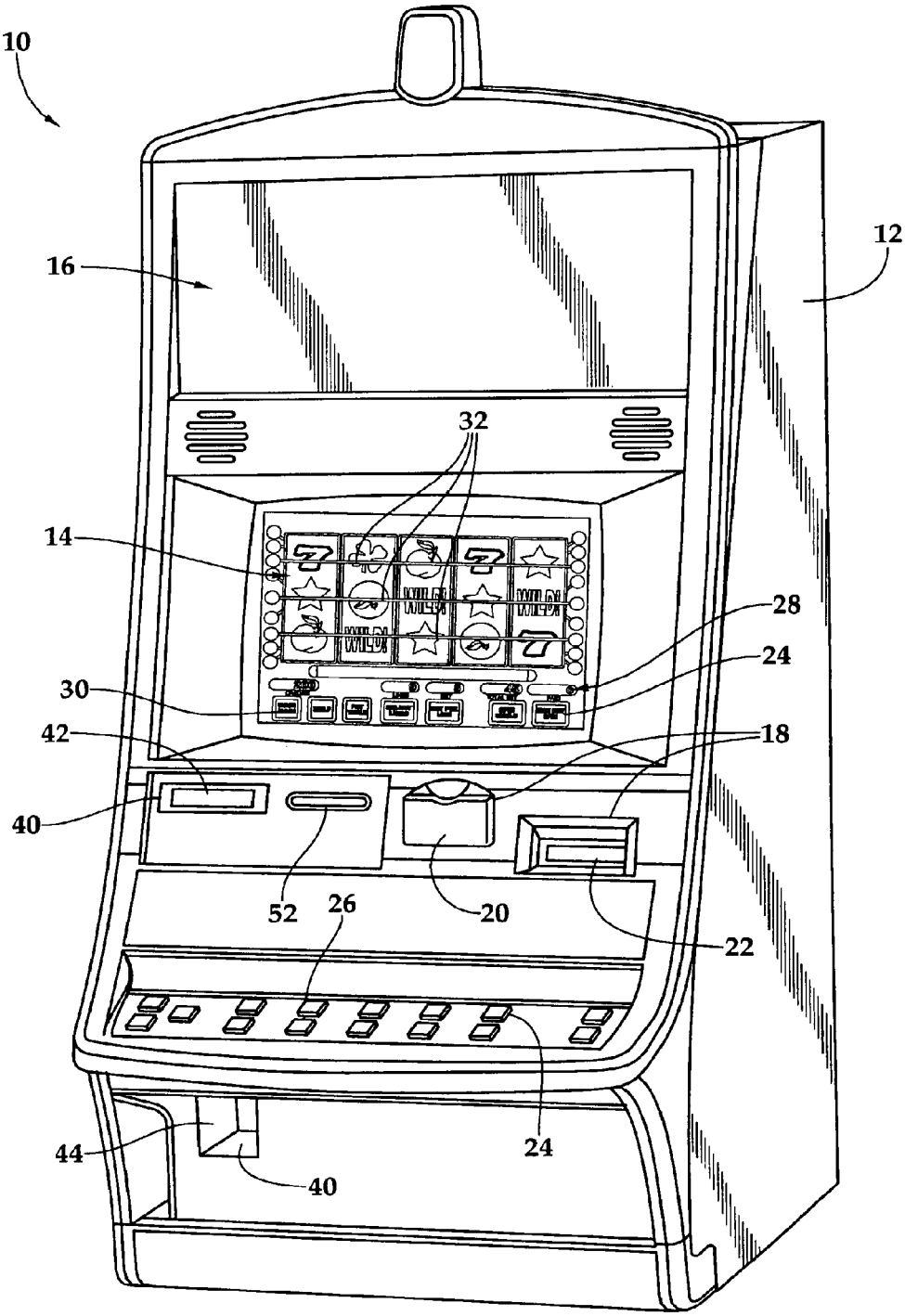
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
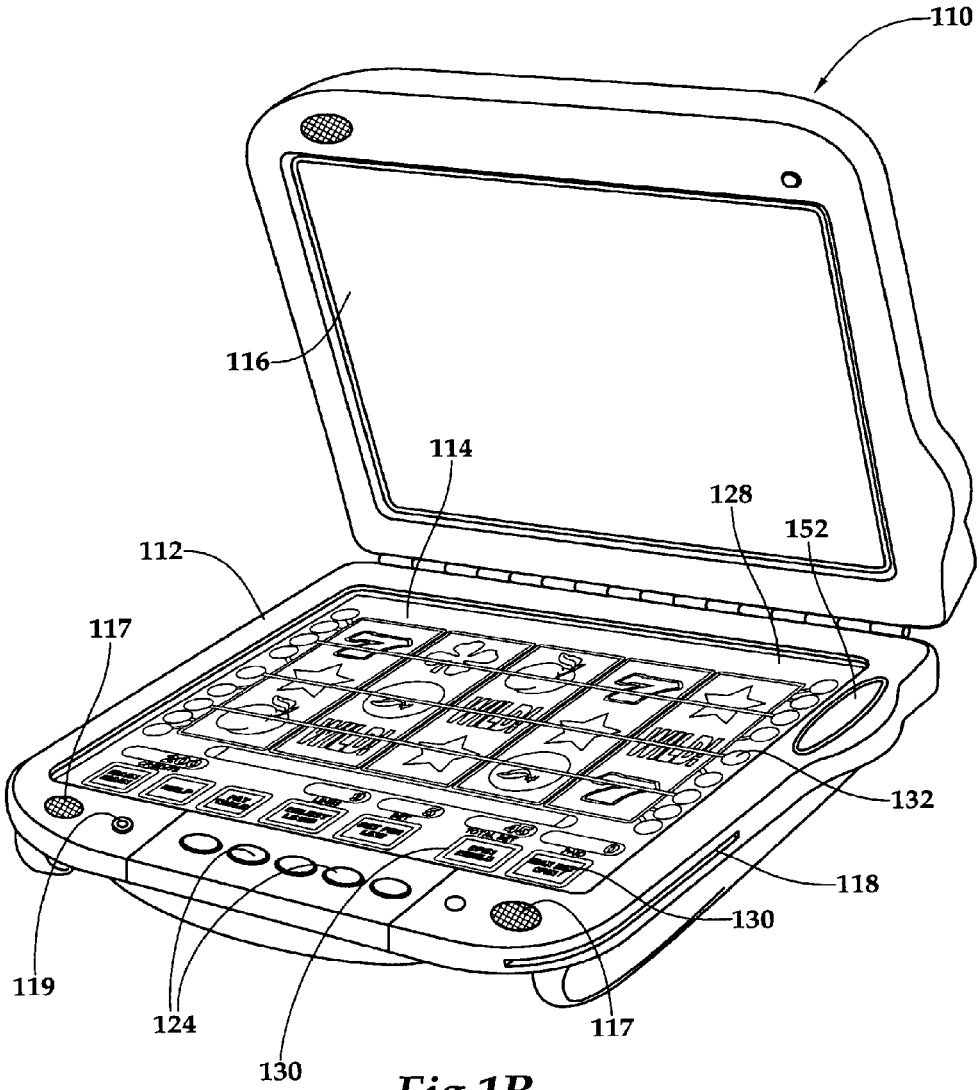
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
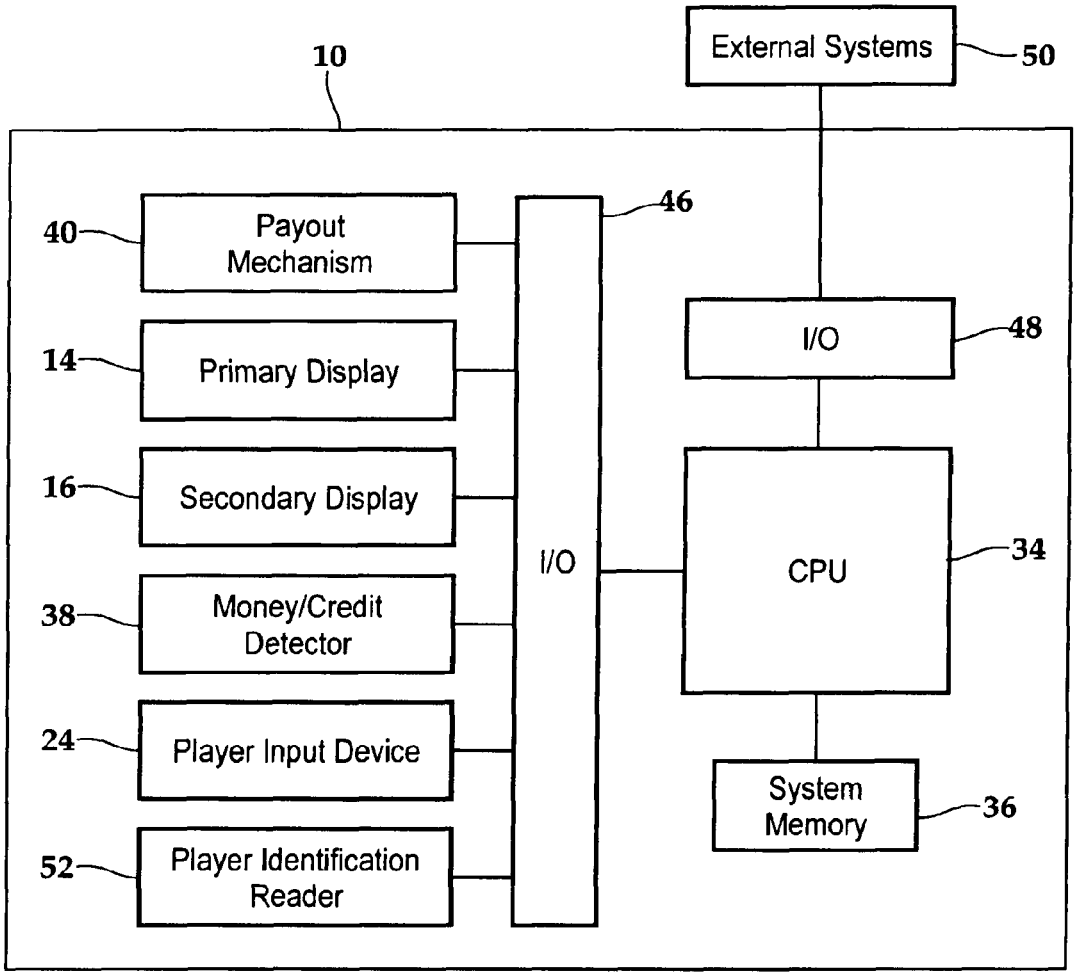
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
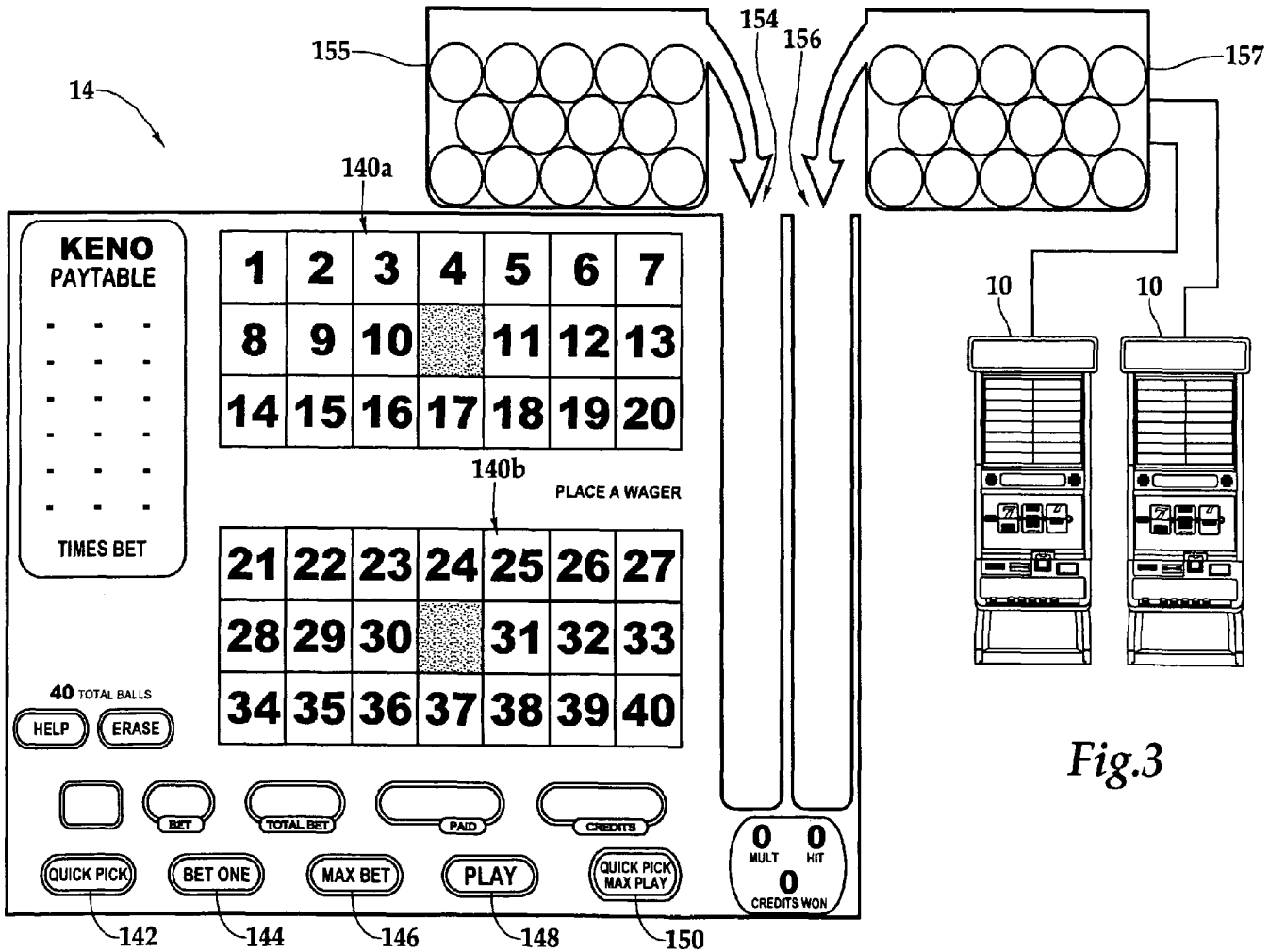
FIG. 3 is an illustration of a basic keno game incorporating the present invention before play of the keno game.

Turning now to FIG. 3, the primary display 14 is showing a basic game incorporating the present invention. In this embodiment, the basic game is a keno game. The primary display 14 includes two electronic game boards 140*a*, 140*b*, containing playable elements having the indicia of numbers 1-40. However, the amount of game boards 140*a*, 140*b* may vary as well as the amount and types of numbers included therein. Furthermore, the electronic game boards 140*a*, 140*b* may include other forms of indicia not limited to numbers. On the bottom of the primary display 14, a quick-pick button 142, a bet-one button 144, a max-bet button 146, a play button 148, and a quick-pick-max-play button 150 are included. The buttons 142-150 may be permanent electromechanical buttons or touch screen buttons.

The primary display 14 also includes an individual hopper display 154 and a community hopper display 156 for displaying randomly selected elements having indicia (e.g., numbers) corresponding to those indicia on the electronic game boards 140*a*, 140*b*. In this embodiment, the randomly selected elements are balls 158 (see FIGS. 5 and 6) having numbers 1-40 located thereon. The individual hopper display 154 displays randomly selected balls 158 from an individual hopper 155, which is associated with the particular gaming machine 10 the player is operating. The community hopper display 156 displays the randomly selected balls 158 from a community hopper 157, which is common to a plurality of gaming machines 10 linked to the community hopper 157, as will be described in more detail below. The individual hopper 155 and the community hopper 157 each contain the same elements, i.e., forty balls 158 numbered 1 through 40.

The player chooses a wager amount by activating either the bet-one button 144 or the max-bet button 146. The bet-one button 144 allows the player to choose a wager less than the maximum up to the allowable maximum wager. The max-bet button 146 places the maximum wager.

Figure 4:
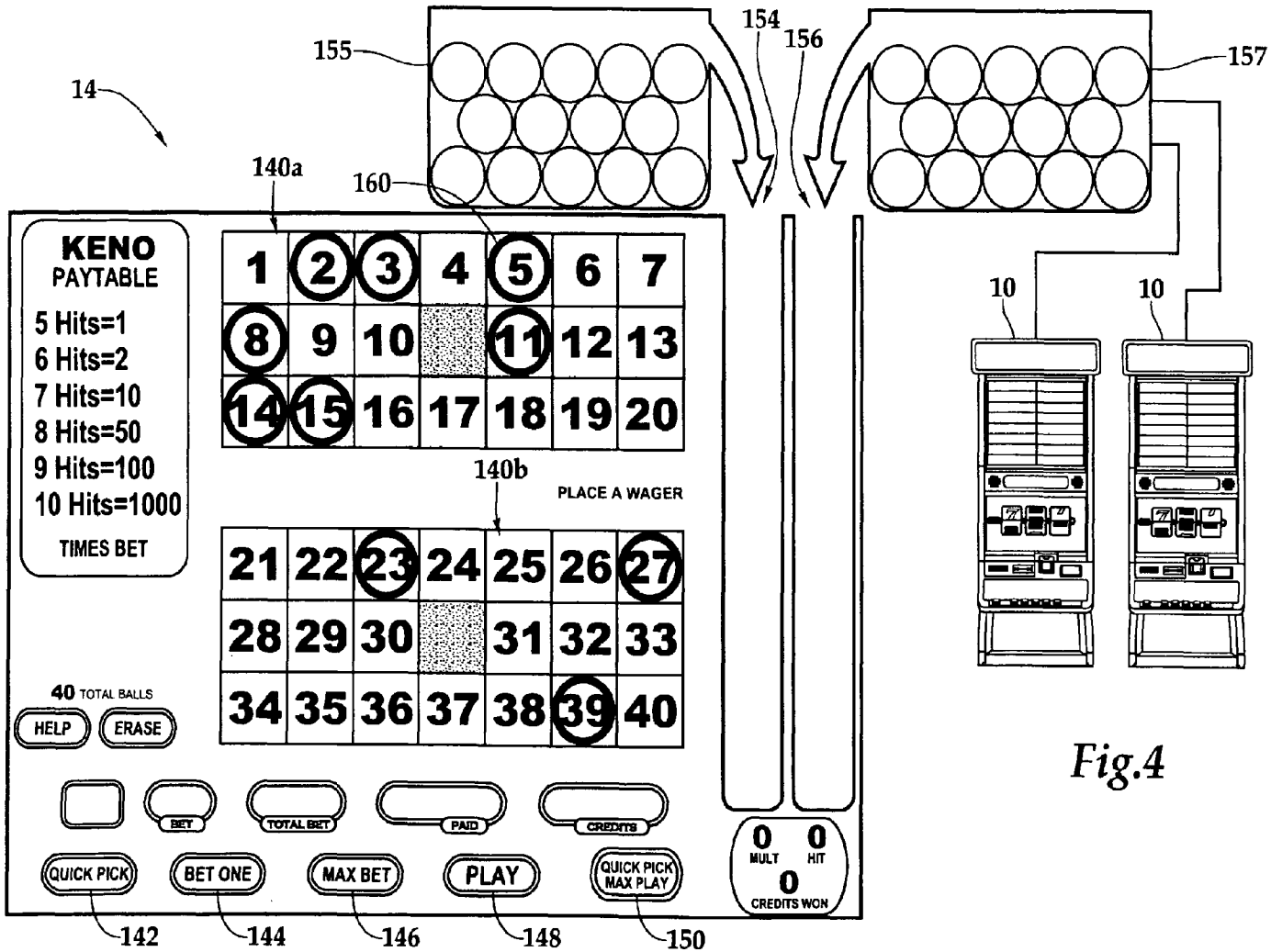
FIG. 4 is an illustration of the keno game incorporating the present invention after player selection.

After making a wager, the player selects a plurality of playable elements (up to ten in this embodiment) from the electronic game boards 140*a*, 140*b*, as illustrated in FIG. 4. Here, the player has chosen the playable elements with the numbers 2, 3, 5, 8, 11, 14, 15, 23, 27, and 39. Alternatively, the player could let the gaming machine 10 randomly choose the playable elements by selecting the quick-pick button 142. Once the player has chosen the playable elements and placed the wager, the player selects the play button 148. Alternatively, the player can choose to make a wager and have the numbers chosen by pressing the quick-pick-max-play button 150. Whether the numbers are selected by the player or by the gaming machine 10, the chosen numbers are indicated on the electronic game boards 140*a*, 140*b* with circles 160 around them.

Figure 5:
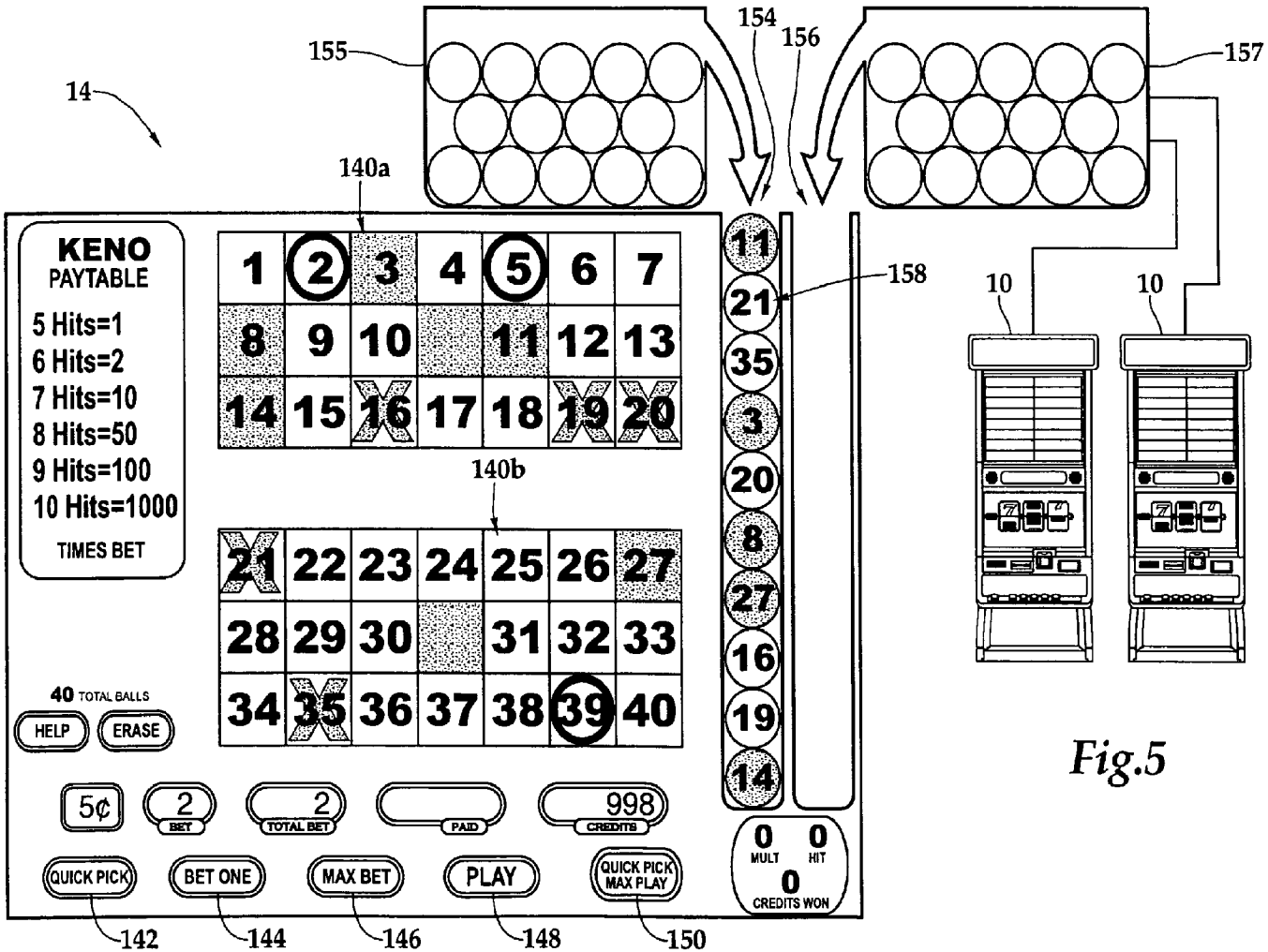
FIG. 5 shows the keno game displaying an individual outcome.

Referring now to FIG. 5, after the player has been assigned or selected the playable elements and activates the play button 148, a group of randomly selected balls 158 having numbers or other indicia corresponding to those on the electronic game boards 140*a*, 140*b*, are sequentially chosen from the individual hopper 155 and are displayed on the individual hopper display 154. The rate of selection may be constant or may be varied. For example, in some embodiments, the gaming terminal 10 may add suspense to the game by choosing the first six balls 158 rather quickly, but then slowing down the selection of the last four balls 158. Alternatively, the period of time between each selection may get longer for each selection. For example, the period of time between the second selection and the third selection may be 1½ times as long as the time between the first and second selection, while the time between the third and fourth selection may be twice as long as the time between the first and second selection, etc. By lengthening the time between the selections, the player may feel added suspense as he or she waits to see the last few balls that determine whether he or she won (or how much they won).

The electronic game boards 140*a*, 140*b* may visually indicate to the player which balls 158 were randomly selected from the individual hopper 155. As shown, the numbers selected on the electronic game boards 140*a*, 140*b* (i.e., 2, 3, 5, 8, 11, 14, 15, 23, 27, 39) that match the numbers on the balls 158 selected from the individual hopper 155 (i.e., 11, 3, 8, 27, 14) are highlighted on the electronic number boards 140*a*, 140*b* to indicate to the player the matching numbers. These numbers may be indicated to the player in other ways including a change in color, blinking colors, shaking, rotating, or other means of visual or audio identification. The balls 158 chosen from the individual hopper 155 having a number that does not match those selected on the electronic game boards 140*a*, 140*b* may also be visually identified to the player. In this particular embodiment, these numbers (i.e., 21, 35, 20, 16, 19) have an "X" placed over them, however, other ways to indicate these non-matches are also contemplated. Similarly, the balls 158 selected from the individual hopper 155 and displayed in the individual hopper display 154 that bear the matching numbers (i.e., 11, 3, 8, 27, 14) may also be highlighted or otherwise identified to the player, as show in FIG. 5.

Figure 6:
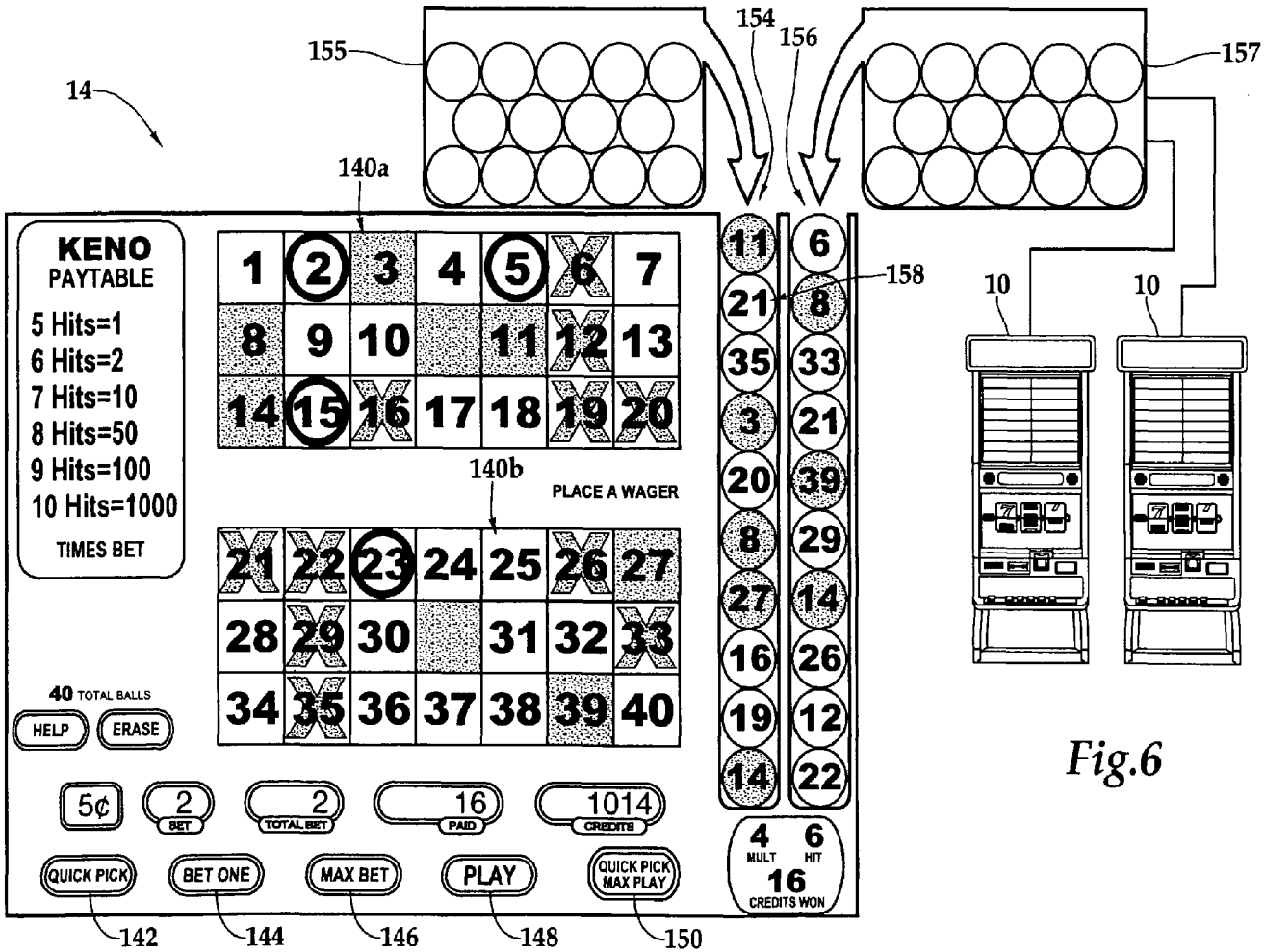
FIG. 6 shows the keno game displaying both the individual outcome and a community outcome.

Referring now to FIG. 6, after the randomly selected balls 158 from the individual hopper 155 are displayed on the individual hopper display 154, the randomly selected balls 158 from the community hopper 157 are displayed on the community hopper display 156. However, the sequence of display between the individual hopper display 154 and the community hopper display 156 is of no consequence and the present invention contemplates any order of occurrence and/or display. The balls 158 selected from the community hopper 157 may be displayed to the player in a similar way as those selected from the individual hopper 155. The matches resulting from the balls 158 selected from the community hopper 157 include numbers 8, 39, and 14. The non-matches resulting from the balls 158 selected from the community hopper 157 include numbers 6, 33, 21, 29, 26, 12, and 22. The ways of indicating to the player which selected numbers on the electronic game boards 140*a*, 140*b* match and do not match those chosen from the community hopper 157 may be done in a similar way as that described above in relation to the individual hopper 155. As shown, the balls 158 bearing the numbers 8 and 14 in the individual hopper 155 and the community hopper 157, matching the selected numbers 8 and 14 on the electronic game board 140*a*, were selected and displayed on both the individual hopper display 154 and the community hopper display 156. When this occurs, a bonus award including the winning of additional credits and/or other awards may be achieved.

As mentioned above, the balls 158 drawn from the individual hopper 155 are associated with the particular gaming machine 10 being played by the player. The balls 158 drawn from the community hopper 157 are common to a plurality of gaming machines 10 potentially being played by a plurality of players. For example, there may be five people playing the keno game incorporating the present invention at five different gaming machines 10. Each gaming machine has its own individual hopper (e.g., 155), and is also linked to one common community hopper (e.g., 157). Each player playing the keno game incorporating the present invention at different gaming machines 10 will generally have a different display of balls 158 in the individual hopper display 154 after a play of the game. However, the balls 158 drawn from the community hopper 157 will be the same for each keno game incorporating the present invention being played at each gaming machine 10. Thus, each game played by the player produces an outcome that includes an individual random event and a community random event.

Different players may play wagering games at different paces. Because the community hopper 157 is common to plurality of gaming machines 10 potentially being played by a plurality of players, the community hopper display 156 in a particular gaming machine 10 will display the same balls 158 as those in other gaming machines 10 incorporating the present invention if they are played within a certain time interval. For example, each gaming machine 10 incorporating the keno game of the present invention that is played (e.g., the player has selected the play button 148) within a certain 5-second period will display the same balls 158 selected from the community hopper 157 in the community display 156. In other words, the selection of balls 158 selected from the community hopper 157 is done every 5 seconds. And the gaming machines 10 played within this 5 seconds will display those balls 158 selected during this period. The time period of 5 seconds is provided by way of example and the timing of the selection of the balls 158 from the community hopper 157 may be more or less than 5 seconds.

The present invention may also be utilized in other types of games. For example, referring now to FIG. 7, an alternative embodiment incorporating the present invention, in the form of a basic slots game, is illustrated. A player can select play by using the player input device 24 (FIG. 2), via the buttons 26 (FIG. 2) or the touch screen keys 30 (FIG. 2). The CPU 34 (or a wagering game control network in alternative embodiments) operates to execute a wagering game program causing the primary display 14 to display the wagering game that includes a plurality of visual elements.

In the illustrated embodiment, a first game screen 201 is used to display a plurality of simulated, movable reels 200*a*-200*e* with symbols displayed thereon. The five depicted (spinning) reels 200*a*-200*e* are positioned such that the symbols are displayed relative to at least one activated payline extending from one of the payline indicators 202*a*-202*i* on the left side of the first game screen 201 to the corresponding payline indicators 202*a*-202*i* on the right side of the first game screen 201. The plurality of symbols displayed on the reels 200*a*-200*e* are used to indicate a plurality of possible outcomes along each of the activated paylines. The reels 200*a*-200*e* displaying these symbols may be either traditional mechanical reels or they may be computer-generated images of reels.

The first game screen 201 may also display a plurality of game session meters and various buttons selectable by a player. The user-selectable buttons include a "collect" button 204 to collect the credits remaining; a "help" button 206 for viewing instructions on how to play the wagering game; a "pay table" button 208 for viewing a pay table associated with the basic wagering game; a "select lines" button 210 for changing the number of paylines a player wishes to play; a "bet per line" button 212 for changing the amount of the wager; a "spin reels" button 214 for moving the reels 200*a*-200*e*; and a "max bet spin" button 216 for wagering a maximum number of credits and moving the reels 200*a*-200*e* of the basic wagering game. While the gaming machine 10 allows for these types of player inputs, the present invention does not require them and can be used on gaming machines having more, less, or different player inputs.

A winning combination occurs when the symbols appearing on the reels 200*a*-200*e* along an active payline correspond to one of the winning symbol combinations listed in a pay table stored in the system memory 36 of the gaming machine 10. The pay table may also be displayed on the secondary display 16, the primary display 14, or both and be either displayed constantly, intermittently, or upon request by a player (e.g., by selecting the pay-table button 208).

A player may play multiple paylines by selecting the select-lines button 210 until the desired number of paylines (up to nine in the illustrated embodiment) are displayed. While an embodiment with nine paylines is shown, a gaming machine 10 with a single payline, or multiple paylines will also work with the present invention. Additionally, although an embodiment with five reels is shown, a gaming machine 10 with any plurality of reels may also be used in accordance with the present invention.

Figure 7:
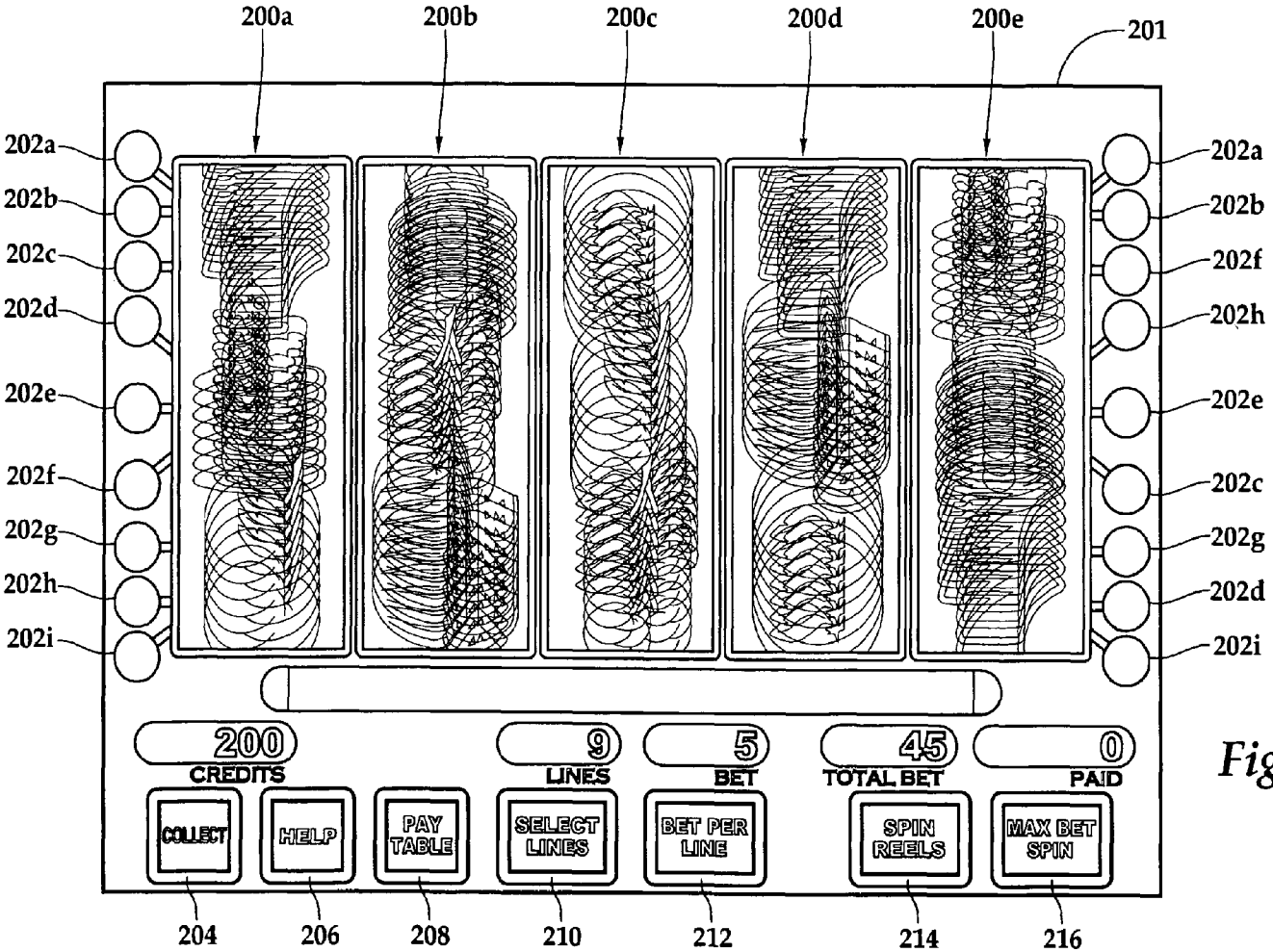
FIG. 7 is an illustration of a basic slots game incorporating the present invention.

The reels 200*a*-200*e* are shown in motion in FIG. 7. A player may make the reels 200*a*-200*e* move by placing a wager using the select-lines button 210, the bet per line button 212 and the spin-reels button 214, or by selecting the max-bet-spin button 216.

In the illustrated embodiment, the first two reels 200*a*, 200*b* are individual reels while the last three reels 200*c*, 200*d*, 200*e* are community reels. Accordingly, the outcome of the individual reels 200*a*, 200*b* are unique to each gaming machine 10 while the outcome of the community reels 200*c*, 200*d*, 200*e* will be the same for each gaming machine 10 linked to the community reels 200*c*, 200*d*, 200*e* that is played within a certain time interval as described above in connection with the keno game incorporating the present invention.

Figure 8:
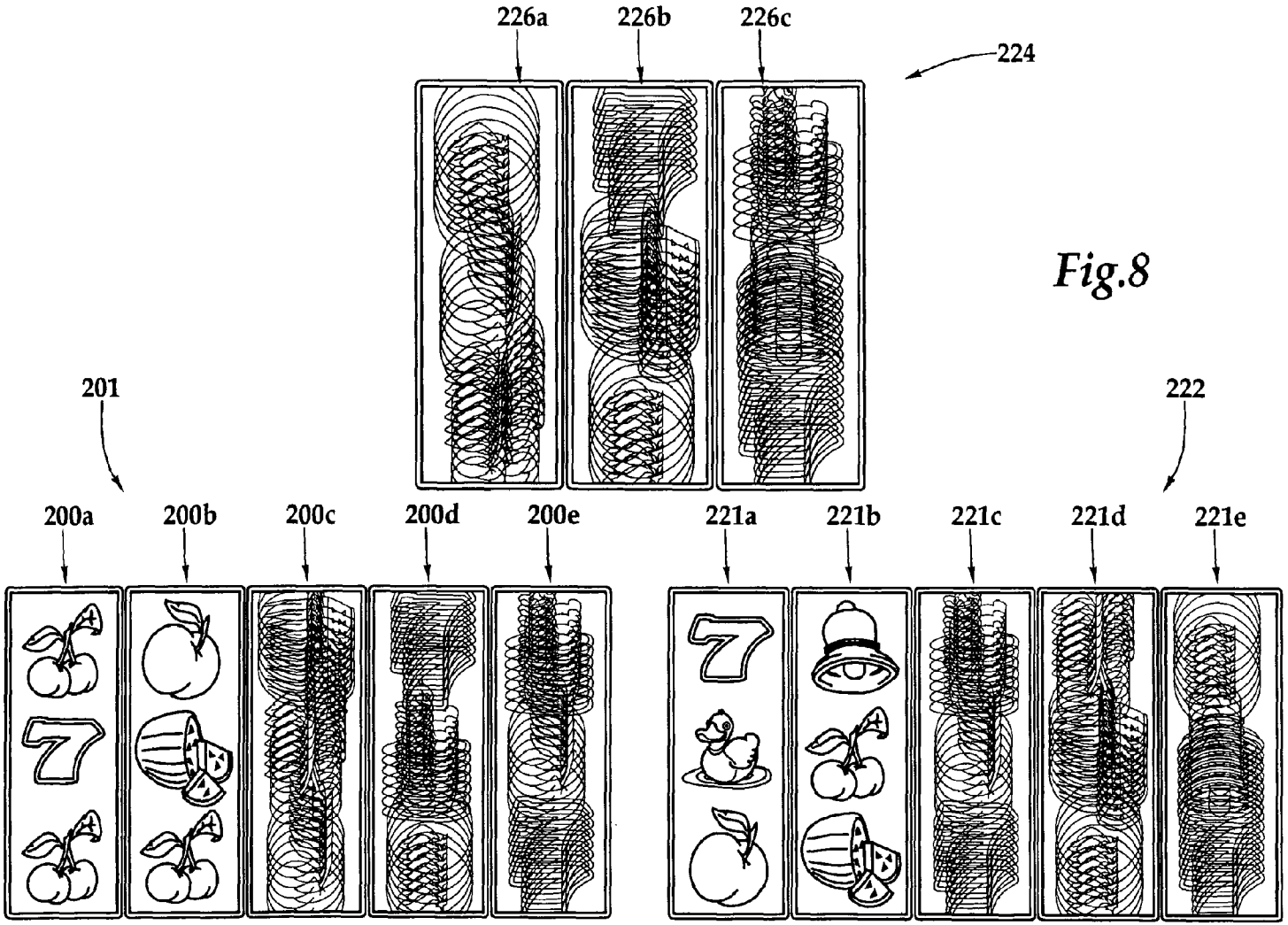
FIG. 8 is a representation of two basic slots game screens after individual reels have stopped spinning and a community game screen with community reels spinning.

Referring now to FIG. 8, the first game screen 201 for a first gaming machine 10*a*, a second game screen 222 for a second gaming machine 10*b*, and a community game screen 224 are illustrated. The first game screen 201 is the game screen illustrated in FIG. 7 after the individual reels 200*a*, 200*b* have stopped spinning. The second game screen 222 represents the game screen of another gaming machine 10*b*. Like the first game screen 201, the second game screen 222 includes individual reels 221*a*, 221*b* and community reels 221*c*, 221*d*, 221*e*. The second game screen 222 is also shown after the individual reels 221*a*, 221*b* have stopped spinning. Accordingly, at this point the first game screen 201 has a first individual outcome while the second game screen 222 has a second individual outcome. As shown in FIG. 8, the first individual outcome on the first game screen 201 is different from the second individual outcome on the second game screen 201.

The community game screen 224 includes community reels 226*a*, 226*b*, 226*c*. The community reels 226*a*, 226*b*, 226*c* represent the community reels that are applied to each gaming machine 10 linked to the community game screen 224. As such, the community reels 226*a*, 226*b*, 226*c* provide symbols to the community reels 200*c*, 200*d*, 200*e* of the first game screen 201 and the community reels 221*c*, 221*d*, 221*e* of the second game screen 222.

The community game screen 224 may be located on a large community display employed in conjunction with a plurality of gaming machines 10 and/or may simply appear on the secondary display 16 of each game. The community game screen 224, as shown in FIG. 8, may not even be a tangible screen, but rather, simply a graphic representation of the community reels of various gaming machines having linked community reels.

Figure 9:
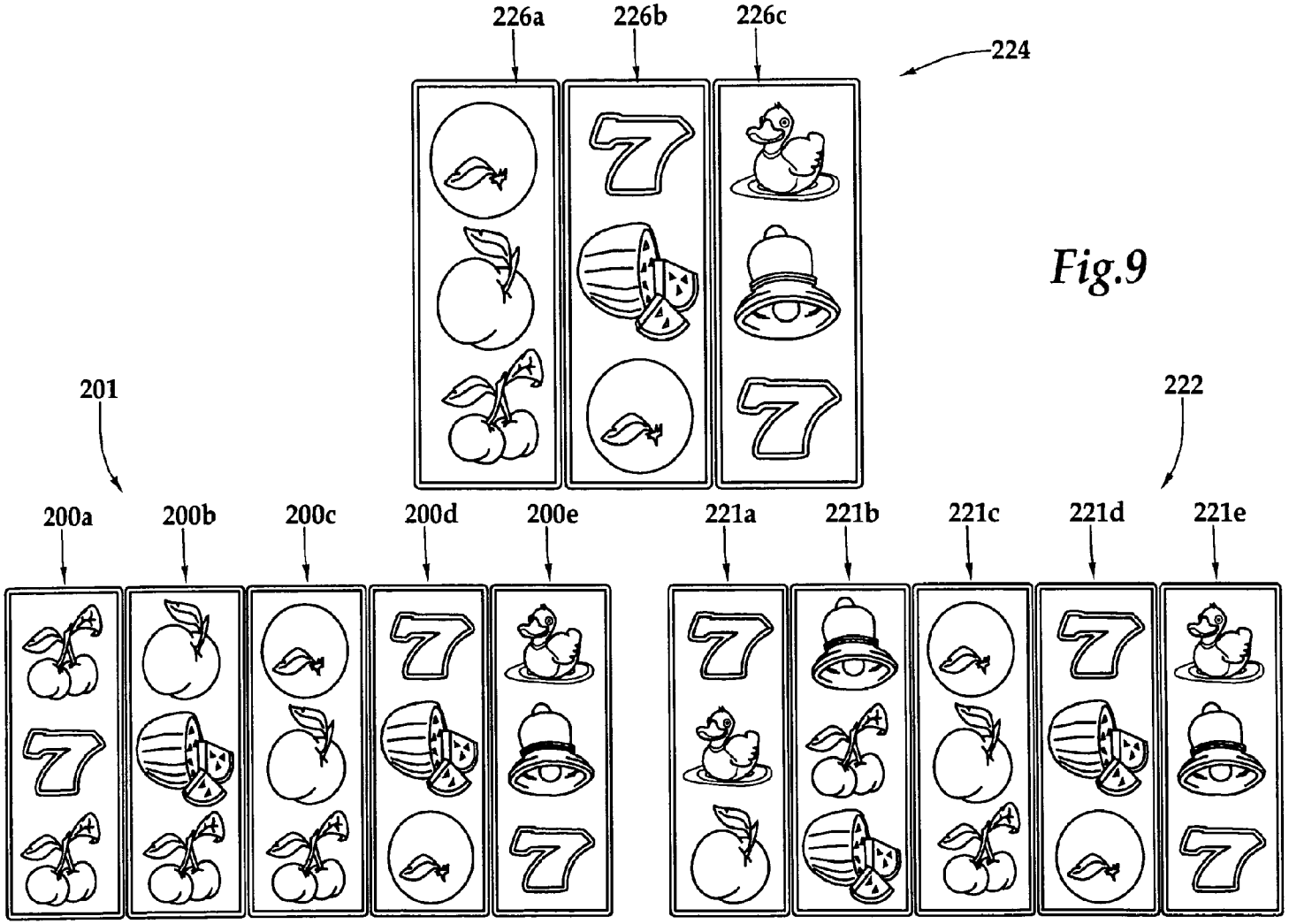
FIG. 9 is an illustration of the game screens of FIG. 8 after all the reels have stopped spinning.

Turning now to FIG. 9, the community reels (200*c*, 200*d*, 200*e* on game screen 201; 221*c*, 221*d*, 221*e* on game screen 222; and 226*a*, 226*b*, 226*c* of game screen 224) have stopped spinning. The combination of symbols on the community reels (e.g., 200*c*, 200*d*, 200*e*) represent a community outcome. Thus, the first game screen 201 of a first gaming machine 10*a* includes the same symbols on the last three reels as the second game screen 222 of a second gaming machine 10*b*.

The final outcome of the first gaming machine 10*a* is the combination of the first individual outcome and the community outcome, while the final outcome of the second gaming machine 10*b* is the combination of the second individual outcome and the community outcome. As shown in FIG. 9, the final outcome of each game includes the combination of an individual outcome and a community outcome. In the illustrated embodiments, the first game screen 201 resulted in a winning outcome (3 cherry symbols on the bottom row of reels 200*a*, 200*b*, 200*c*), while the second game screen 222 did not produce a winning outcome. Furthermore, it should be noted that winning combinations (i.e., winning outcomes) do not necessarily have to include payline wins. For example, a winning outcome may occur as a scatter payout. A scatter payout occurs when a pre-determined number of designated scatter symbols appear on the game screen of the gaming machine 10, without regard to paylines. In some embodiments, the pre-determined number of designated scatter symbols may be one.

It bears noting that the outcome determination engine(s) or random number generator(s) (RNG) used to determine outcomes for one or more of the community hopper 157, individual hopper 157, community reels 200*c-e*, 221*c-e*, 226*a-c*, and/or individual reels 200*a-b*, 221*a-b* may be disposed anywhere, locally or remotely. Typically, but not necessarily, a local RNG is located in each gaming machine 10 and generates random outcomes for the individual hopper 155 and individual reels 200*a-b*, 221*a-b*. Alternatively, the RNG for the individual hopper 155 and individual reels 200*a-b*, 221*a-b* may reside remote from the gaming machine in association with a remote server, service or external system 50.

In at least some embodiments, for example, the community hopper 157 and the community reels 200*c-e*, 221*c-e*, 226*a-c* are remotely controlled by a controller having or being associated with an outcome determination engine (e.g., community RNG) configured to randomly select the symbols on the community reels 226*a-c* and randomly select the balls 158 dispensed from the community hopper 157 in the embodiments described above, and others falling within the scope of the present invention. In another embodiment, one or more community RNGs for community reels 226*a-c* and/or community hopper 157 may be located in a gaming machine 10 and share the community outcome with other gaming machines 10, such as in a peer-to-peer or client/server architecture, or other network architecture in any configuration (e.g., hub and spoke, star, ring, bus, etc.). Multiple gaming machines 10 may be configured to include such community RNGs, such as to provide enhanced system flexibility, security, and/or redundancy. Other variations of the outcome determination engine are also contemplated and fall within the scope of the present invention.

Each of these embodiments and obvious variations thereof is contemplated as falling within the spirit and scope of the claimed invention, which is set forth in the following claims.

What is claimed is:

1. A method of conducting a slots game on a gaming system, the method comprising:

displaying a first individual outcome on at least one of one or more game screens, the first individual outcome being indicated by a plurality of symbols arranged in a first individual array on a plurality of first individual reels of a first slots game;

displaying a second individual outcome on at least one of the one or more game screens, the second individual outcome being indicated by a plurality of symbols arranged in a second individual array on a plurality of second individual reels of a second slots game;

displaying a community outcome on at least one of the one or more game screens, the community outcome being indicated by a plurality of symbols arranged in a community array on a plurality of community reels, the community outcome being applied to the first and second slots games;

determining, via at least one of one or more processors, a first award for the first slots game in response to a first winning symbol combination located within a first final array defined by a first combination of the first individual array and the community array; and determining, via at least one of the one or more processors, a second award for the second slots game in response to a second winning symbol combination located within a second final array defined by a second combination of the second individual array and the community array, wherein the first winning symbol combination is different from the second winning symbol combination and at least one of the winning symbol combinations includes an appearance of a predetermined number of symbols along a payline.

2. The method of claim 1, wherein at least one of the winning symbol combinations includes a scatter win.

3. The method of claim 2, wherein the scatter win includes an appearance of one or more predetermined symbols anywhere in at least one of the final arrays.

4. The method of claim 1, wherein the first individual outcome is independent from the second individual outcome.

5. The method of claim 1, wherein at least one of the individual arrays is formed on a plurality of rotatable electromechanical reels.

6. The method of claim 1, wherein the community array is formed on a plurality of rotatable electromechanical reels.

7. The method of claim 1, wherein the first winning symbol combination includes symbols from the first individual outcome and the community outcome, and the second winning symbol combination includes symbols from the second individual outcome and the community outcome.

8. A computer-implemented method of conducting a wagering game on a gaming system, the method comprising:

displaying a first individual outcome at a first gaming machine, the first individual outcome being indicated by a plurality of symbols arranged in a first individual array on a plurality of reels of a first slots game;

displaying a second individual outcome at a second gaming machine, the second individual outcome being indicated by a plurality of symbols arranged in a second individual array on a plurality of reels of a second slots game;

displaying a community outcome, the community outcome being indicated by a plurality of symbols arranged in a community array on a plurality of community reels;

combining, via at least one of one or more processors, the first individual outcome with the community outcome to form a first overall outcome;

combining, via at least one of the one or more processors, the second individual outcome with the community outcome to form a second overall outcome; and determining, via at least one of the one or more processors, an award in response to either or both of the overall outcomes forming a winning symbol combination, the first overall outcome being different from the second overall outcome, wherein the winning symbol combination includes an appearance of a predetermined number of symbols along a payline.

9. The computer-implemented method of claim 8, wherein the first overall outcome includes symbols from the first individual outcome and the community outcome, and the second overall outcome includes symbols from the second individual outcome and the community outcome.

10. The computer-implemented method of claim 8, wherein at least one of the individual arrays is formed on a plurality of rotatable electromechanical reels.

11. The computer-implemented method of claim 8, wherein the community array is formed on a plurality of rotatable electromechanical reels.

12. The computer-implemented method of claim 8, wherein the winning symbol combination includes a scatter win.

13. The computer-implemented method of claim 12, wherein the scatter win includes an appearance of one or more predetermined symbols anywhere in at least one of the overall outcomes.

14. The computer-implemented method of claim 8, wherein the first individual outcome is independent from the second individual outcome.

15. A gaming system for playing a first slots game and a second slots game, the gaming system comprising:

at least one input device;

one or more display devices for displaying the first slots game, the second slots game, and a plurality of community reels;

one or more processors;

at least one memory device storing instructions that, when executed by the at least one of the one or more processors, cause the gaming system to:

display, via at least one of the one or more display devices, a first individual outcome on a plurality of reels of a first slots game, the first individual outcome comprising first elements randomly selected from a set of individual elements;

display, via at least one of the one or more display devices, a second individual outcome on a plurality of reels of a second slots game, the second individual outcome comprising second elements randomly selected from the set of individual elements, the second individual outcome being different from the first individual outcome;

display, via at least one of the one or more display devices, a community outcome on a plurality of community reels, the community outcome comprising community elements randomly selected from a set of community elements;

determine a first award for the first slots game in response to matching at least some of the first elements from the first individual outcome with at least some of the community elements from the community outcome to form a first winning combination; and determine a second award for the second slots game in response to matching at least some of the second elements from the second individual outcome with at least some of the community elements from the community outcome to form a second winning combination, wherein at least one of the winning combinations includes an appearance of a predetermined number of elements along a payline.

16. The gaming system of claim 15, wherein the one or more display devices include a first individual display region for displaying the first individual outcome, a second individual display region for displaying the second individual outcome, and a community display region for displaying the community outcome.

17. The gaming system of claim 15, wherein the one or more display devices includes a first individual display device for displaying the first individual outcome, a second individual display device for displaying the second individual outcome, and a community display device for displaying the community outcome.

18. The gaming system of claim 15, wherein at least one of the winning combinations is based on a scatter win.

19. The gaming system of claim 18, wherein the scatter win includes an appearance of one or more predetermined elements anywhere in the first individual outcome, the second individual outcome, or the community outcome.

20. The gaming system of claim 15, wherein the first individual outcome is independent from the second individual outcome.

21. The gaming system of claim 15, wherein at least one of the individual outcomes is formed on a plurality of rotatable electromechanical reels.

22. The gaming system of claim 15, wherein the community outcome is formed on a plurality of rotatable electromechanical reels.

* * * * *